US011380292B2

(12) United States Patent
Cho

(10) Patent No.: US 11,380,292 B2
(45) Date of Patent: Jul. 5, 2022

(54) KEYPAD STRUCTURE FOR WOODWIND INSTRUMENT TONE HOLES

(71) Applicant: Myung Sub Cho, Incheon (KR)

(72) Inventor: Myung Sub Cho, Incheon (KR)

( * ) Notice: Subject to any disclaimer, the term of this patent is extended or adjusted under 35 U.S.C. 154(b) by 0 days.

(21) Appl. No.: 17/373,244

(22) Filed: Jul. 12, 2021

(65) Prior Publication Data

US 2022/0020344 A1 Jan. 20, 2022

(30) Foreign Application Priority Data

Jul. 16, 2020 (KR) ..... 10-2020-0087887

(51) Int. Cl.
*G10D 9/047* (2020.01)
*G10D 9/08* (2020.01)
*G10D 7/06* (2020.01)

(52) U.S. Cl.
CPC ..... *G10D 9/047* (2020.02); *G10D 7/06* (2013.01); *G10D 9/08* (2020.02)

(58) Field of Classification Search
CPC ..... G10D 9/047; G10D 7/06; G10D 9/08; G10D 7/08; G10D 9/10; G10D 9/04
See application file for complete search history.

(56) References Cited

U.S. PATENT DOCUMENTS 3,623,391 A * 11/1971 Nagao ..... G10D 9/047 984/145

FOREIGN PATENT DOCUMENTS

| | | | |
|---|---|---|---|
| JP | 2001-142458 | A | 5/2001 |
| JP | 2005-234511 | A | 9/2005 |
| JP | 2007-010131 | A | 1/2007 |
| KR | 10-1005847 | B1 | 1/2011 |

* cited by examiner

*Primary Examiner* — Kimberly R Lockett
(74) *Attorney, Agent, or Firm* — KORUS Patent, LLC; Seong Il Jeong

(57) ABSTRACT

The present disclosure relates to a keypad structure for woodwind instrument tone holes, and more particularly, to a keypad structure for woodwind tones which improves the adhesion of a keypad connected to a tone hole tube in which the tone hole is formed in the woodwind instrument, prevents the sound from being exposed to the outside through the tone hole tube and the pad, and can generate excellent resonance so that the resonance of a desired sound can be constantly generated through the closed keypad.

2 Claims, 9 Drawing Sheets

KEYPAD STRUCTURE FOR WOODWIND INSTRUMENT TONE HOLES

BACKGROUND OF THE INVENTION

(a) Field of the Invention

The present disclosure relates to a keypad structure for woodwind instrument tone holes, and more particularly, to a keypad structure for woodwind tones which improves the adhesion of a keypad connected to a tone hole tube in which the tone hole is formed in the woodwind instrument, prevents the sound from being exposed to the outside through the tone hole tube and the pad, and can generate excellent resonance so that the resonance of a desired sound can be constantly generated through the closed keypad.

(b) Description of the Related Art

Generally, the sound transmitted through a woodwind instrument utilizes the vibration of air.

A large number of cap holders are formed inside the woodwind instrument, pads are connected to the inside of the cap holders, and the pads are allowed to vibrate, so that the woodwind instrument makes a sound in resonance.

As mentioned above, music through sound, which utilizes the transmission of air, is the art of sound, and musical sound and all sounds are generated from the vibration of air. The woodwind instrument is a regulator that regulates the flow of air, and is a tool that utilizes the effects of vibration to change it into a musical sound.

In other words, performance music also utilizes vibration phenomena in the air, and performance is a physical phenomenon in which the vibration phenomenon using a musical instrument is heard through an auditory organ via a medium called air.

As described above, vibration is converted into sound and expressed through performance. The source of musical sound and the source of performance are started from vibration caused by breathing, and the technology of adjusting the vibration is a key principle for adjusting musical tools and musical instruments.

Musical instrument performance adjusts vibration to change it into an artistic sound, and expresses this vibration with an artistic sound to express emotions. The sound gets better when the vibration is strengthened, and utilizing this resonance artistically is a wonderful performance.

In order to improve the quality of live music performance in analog state, it is essentially important to improve the performance of the musical instrument itself. For this reason, professional musicians prefer and choose to use an expensive exquisite instrument with good sound quality in their concerts. In this way, a good instrument called an exquisite instrument refers to a musical instrument having good sound quality, good tone, abundant volume, and good sound and resonance. In addition, a musical instrument with good resonance refers to a musical instrument with regular vibrational periodicity, that is, a musical instrument with a regular vibrational periodicity and a good vibrational periodicity refers to an exquisite instrument.

The principle of generation of sound from musical instruments is as shown in FIG. 1. Usually, a space S is generated between the upper peripheral edge part 1*b* of a tone hole tube 1 in which the tone hole 1*a* is formed, and the pad 2 that is detachably attached to the upper peripheral edge part 1*b* and closes the upper peripheral edge part, and a vibration sound leaks through a space S and thus, an original desired sound is not generated. As a method of strengthening the resonance for the periodicity of these vibrations, a method of removing the space S, which is a gap, is used when the pad 2 is in close contact with the upper peripheral edge part 1*b* of the tone hole tube 1. As the most widely used method of removing the space S, which is such a gap, the method, in which a metal plate M is inserted between the upper peripheral edge part 1*b* of the tone hole tube 1 and the pad 2, and the pad 2 presses the surface of the key 3 attached to the inside to forcibly deform a space S that is a gap. This forcibly deforming method deforms an arm 4 on the surface of the key 3, and therefore, a correct sound is not generated due to the deformation of the musical instrument, and the durability of the instrument is weakened. While a certain period of time passes as a temporary expedient, the space S, which is a gap, is opened again, and there is no choice but to repair it again. In addition, even when the pad 2 is torn during use or worn out after a long period of use, the pad 2 must be replaced, and the replaced pad 2 also had a problem that, after the passage of a certain period of time as above, the space S, which is a gap, is opened again.

As a method of changing a different tone color, an invention entitled 'Method for Producing a Woodwind Instrument having a Resonance Strengthening Function and a Woodwind Instrument Thereof' has been proposed in Korean Patent Registration No. 10-1005847. The method for strengthening the resonance of a woodwind instrument of this patent proposes a method in which a cap holder is formed on the inside and a pad is connected to the cap holder, the method comprising: a stirring step of stirring a mixture of a solid silicon and an energizing medium containing any one or more of platinum, gold, silver, copper, nickel, bronze, brass, and phosphor bronze; a mixture heating step of heating the stirred mixture at 80° C. for 10 to 15 minutes; a solidification step of naturally cooling the heated mixture and solidifying it into a solid; a mixture crushing step of crushing the mixture; a mixture applying step of applying the mixture in a cap holder; a pad connecting step of connecting a pad to the inside of the cap holder after the step of applying the mixture. However, since the above proposed method cannot completely fill a space between the inside surfaces of the pad 2 and the key 3, a space S, which is also a gap described above, is generated, and the above method should use an expensive energizing medium and thus, is not widely used in practice because the production cost or repair cost is high.

PRIOR ART LITERATURE

Patent Literature (Patent Literature 0001) Korean Patent Registration No. 10-1005847

SUMMARY OF THE INVENTION

Technical Problem

Therefore, the present disclosure has been designed to solve the above-mentioned problems, and it is an object of the present disclosure to provide a keypad structure for woodwind instrument tone holes which improves the adhesion of a keypad connected to a tone hole tube in which the tone hole is formed in the woodwind instrument, prevents the sound from being exposed to the outside through the tone hole tube and the pad, and can generate excellent resonance so that the resonance of a desired sound can be constantly generated through the keypad.

Technical Solution

In order to achieve the above object, the present disclosure provides a keypad structure for woodwind instrument tone holes comprising: tone hole tubes in which tone holes are formed on the woodwind instrument, a pad that detachably closes the tone holes of the tone hole tubes, and a key to which the pad is attached to the inside, wherein a filler such as shellac, silicone, paper or vinyl having a component similar or identical to an adhesive component of the pad and key is inserted into an empty space inside the pad and the key, which is heated, and thereby, the empty space inside the pad and the key is removed.

Advantageous Effects

A keypad structure for woodwind instrument tone holes according to the present disclosure includes tone hole tubes in which tone holes are formed on the woodwind instrument, a pad that detachably closes the tone holes of the tone hole tubes, and a key to which the pad is attached to the inside, wherein a filler such as shellac, silicone, paper or vinyl having a component similar or identical to an adhesive component of the pad and key is inserted into an empty space inside the pad and the key, which is heated, and thus, the empty space inside the pad and the key is removed, whereby the keypad structure improves the adhesion of a keypad connected to a tone hole tube in which the tone hole is formed in the woodwind instrument, prevents the sound from being exposed to the outside through the tone hole tube and the pad, and can generate excellent resonance so that the resonance of a desired sound can be constantly generated through the keypad.

DETAILED DESCRIPTION OF THE EMBODIMENTS

Figure 1A:
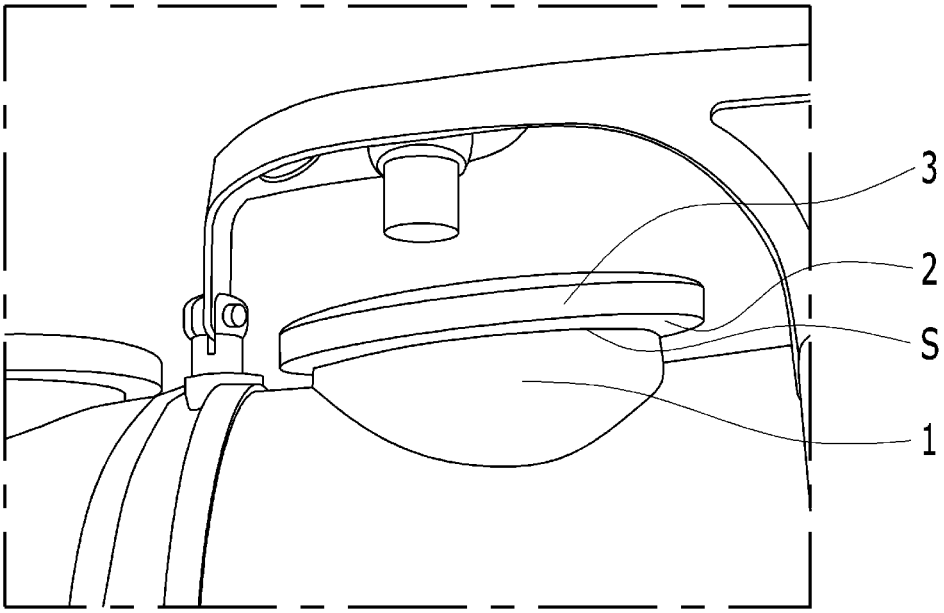
FIGS. 1A, 1B and 1C are a photograph showing an opened space between the conventional defective tone hole tube and the pad, a photograph showing a method of repairing it, and a cross-sectional view of a keypad in which a conventional key and pad are joined.
Figure 1B:
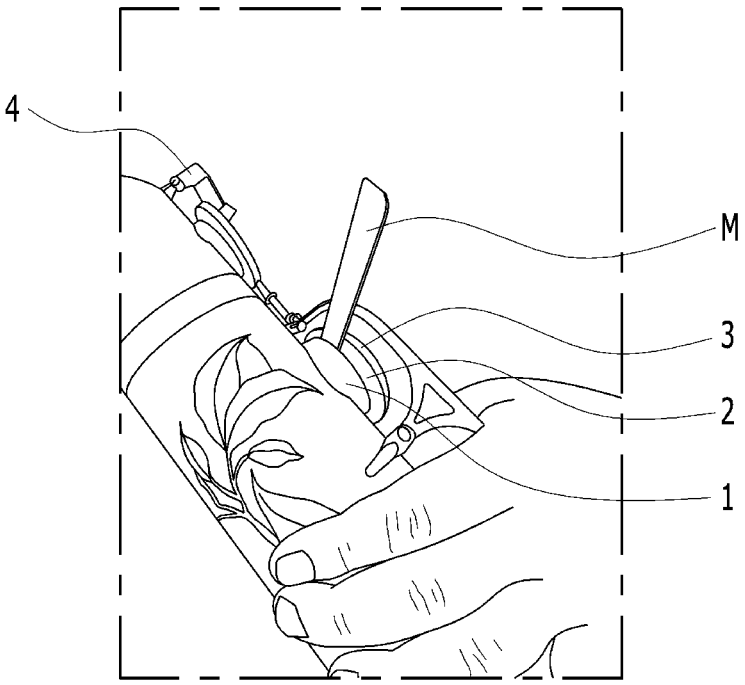
Figure 1C:
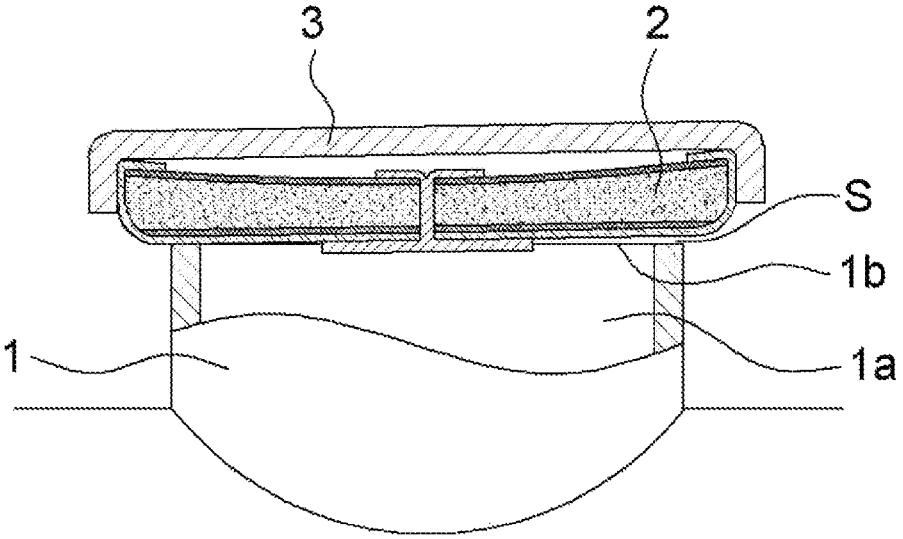
Figure 2:
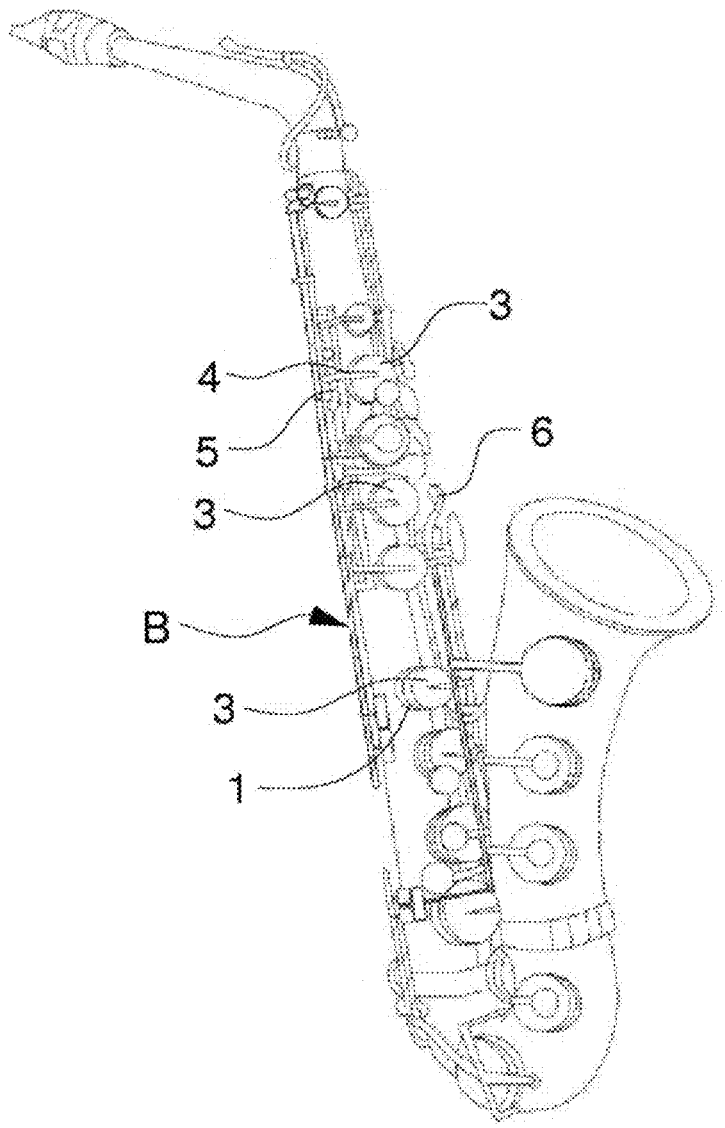
FIG. 2 is a schematic perspective view of a saxophone, which is a type of woodwind instrument.
Figure 3:
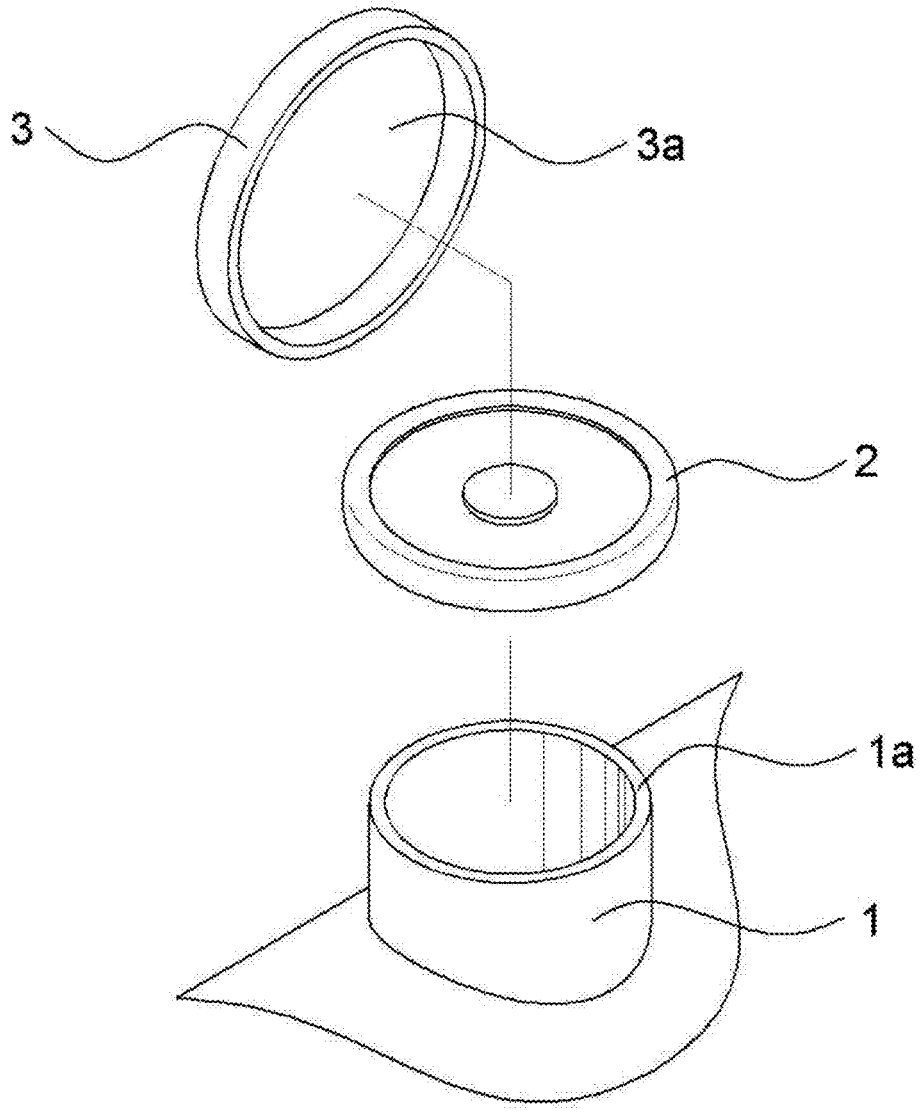
FIG. 3 is an exploded perspective view of the keypad structure for woodwind instrument tone holes according to a first embodiment of the present disclosure.

A keypad structure A for woodwind instrument tone holes according to a first embodiment of the present disclosure includes a plurality of tone hole tubes 1 in which tone holes 1*a* are formed on the woodwind instrument B, a pad 2 detachably attached to the tone hole tube 1, and a key 3 to which the pad 2 is attached to the inside surface and which moves the pad 2.

The keypad structure A for woodwind instrument tone holes according to a first embodiment of the present disclosure is provided with tone hole tubes 1 in which tone holes la are formed, and a large number of pads 2 that detachably closes the tone holes la of the tone hole tubes 1.

In the keypad structure A for woodwind instrument tone holes according to a first embodiment of the present disclosure, one side of the pad 2 is in close contact with the upper peripheral edge part 1*b* of the tone hole tube 1, and the other side is attached to the inside surface of the key 3 and detachably moves the pad 2.

The keypad structure has a structure in which one end of the arm 4 is attached to the outside of the key 3, and the other end of the arm 4 is connected to the key rod 5 and a key button 6 is disposed. Since the part of importantly dealing the keypad structure A for woodwind instrument tone holes according to the first embodiment of the present disclosure is the structure of the tone hole tube 1, the pad 2, and the key 3, it is considered that the description of other parts may be omitted, and thus the description thereof will be omitted below.

As already described in the prior art, a space S is generated between the pads 2 that are detachably attached to the upper peripheral edge part 1*b* of the tone hole tube 1 and close the upper peripheral edge part, and a vibration sound is leaked through the space S, so that the original sound is prevented from being generated.

The reason for this is that the space between the pads 2 adhesively fixed to the inside surface 3*a* of the key 3 is not completely filled, and an empty inside space S1 is partially generated, and even when the pad 2, which is detachably attached to the upper peripheral edge part 1*b* of the tone hole tube 1 by the inside space S1 and closes the upper peripheral edge part, is closed, the empty inside space S1 is pressed irregularly to create a space S of the opened gap.

The pad 2 includes a leather-made contact leather part 2*a* that is in contact with the upper peripheral edge part 1*b* of the tone hole tube 1, an intermediate overlapping part 2*b* in which a large number of thin papers disposed on the inside of the contact leather part 2*a* are overlapped, and an inside leather part 2*c* in which the edge of the contact leather part 2*a* is adhered to the inside edge of the intermediate overlapping part 2*b*. The keypad structure A for tone holes of all woodwind instruments is configured such that an empty inside space S1 is formed between the inside leather part 2*c* of the pad 2 and the inside surface 3*a* of the key 3.

Looking at the structure of the pad 2 in more detail, the intermediate overlapping part 2*b* of the pad 2 is composed of a synthetic fiber fabric, a thin paper aggregate, and the like, a thin paper is attached to the upper and lower surfaces of the intermediate overlapping part 2*b*, a contact leather part 2*a* and the inner leather part 2*c* are adhered to the upper and lower surfaces of the intermediate overlapping part 2*b*, and it is fixed by a fixing plate 2*e* which penetrates through the contact leather part 2*a*, the intermediate overlap part 2*b*, and the paper 2*d* in the middle.

Figure 5A:
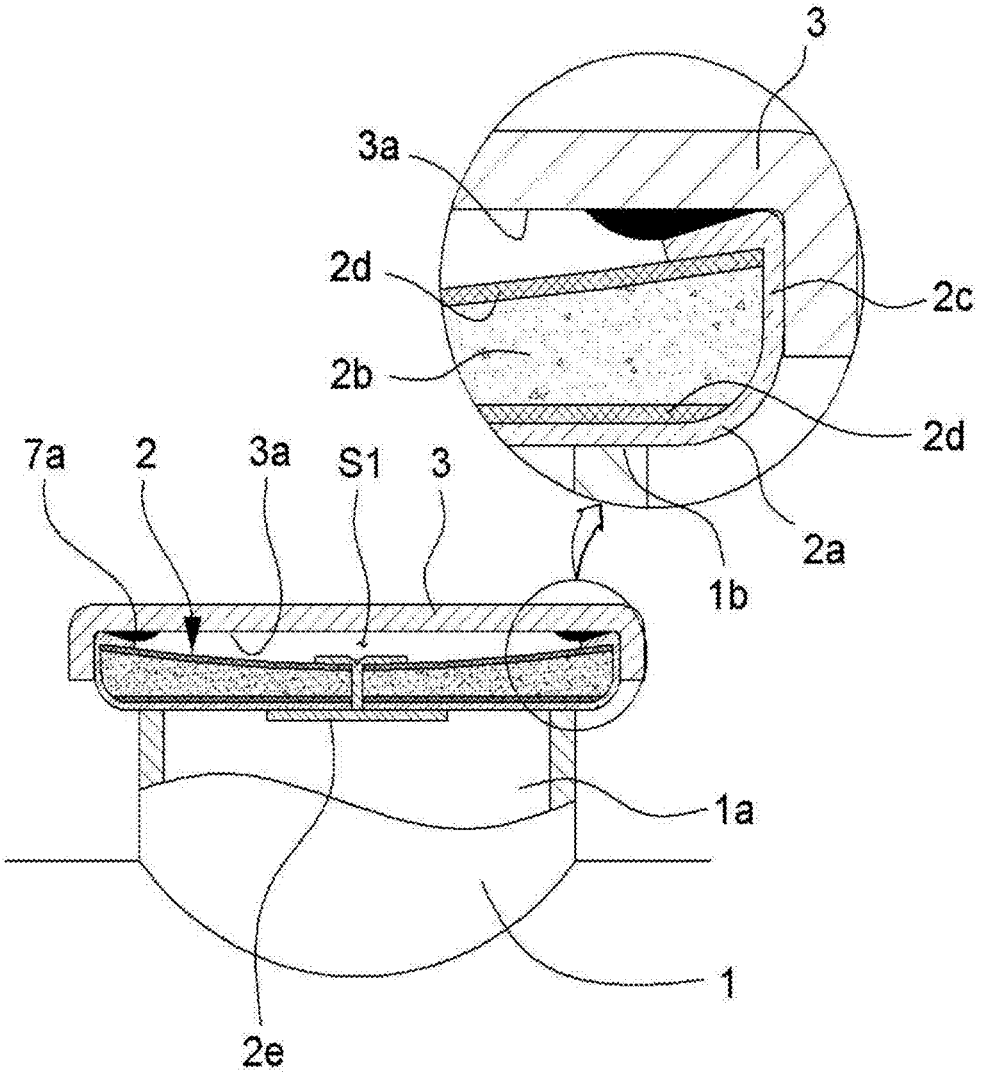
FIGS. 5A, 5B and 5C are schematic longitudinal cross-sectional views of a keypad structure for a woodwind instrument tone hole according to a first embodiment of the present disclosure, a longitudinal sectional view of the gap space at the time of deformation, and a longitudinal cross-sectional view at the time of filling.
Figure 5B:
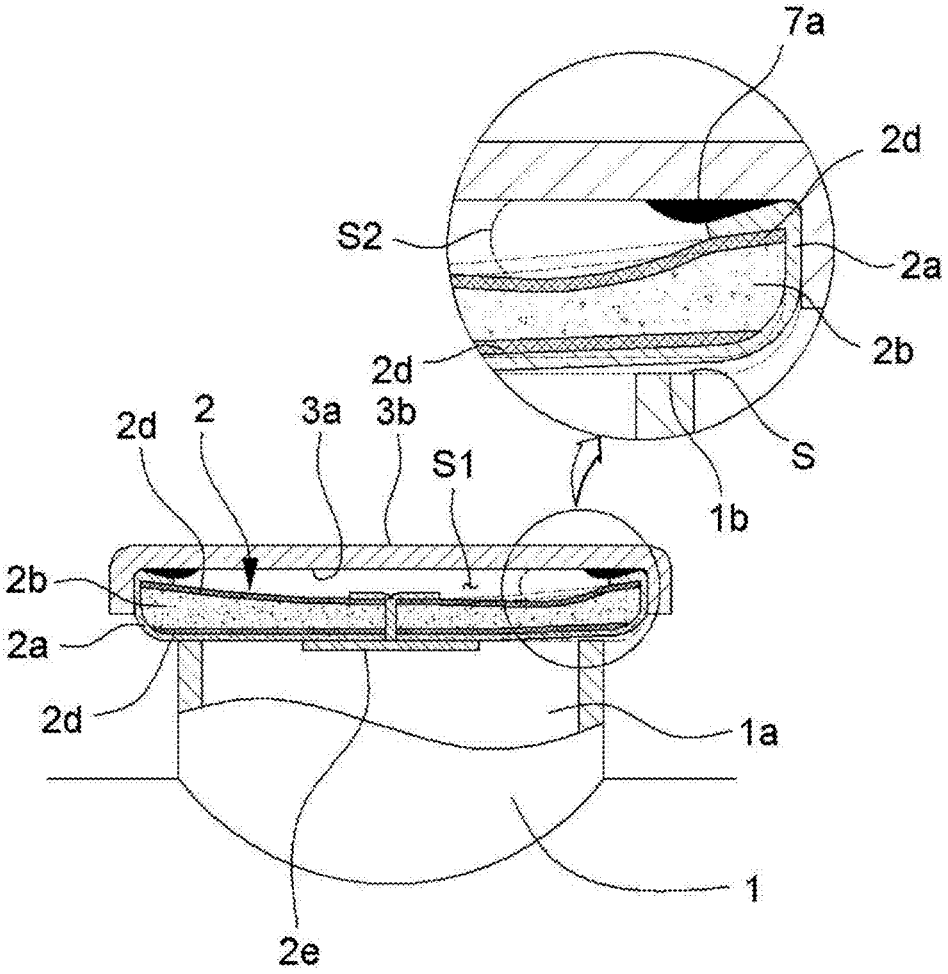

Since all of the keypad structures A for tone holes are used so that an empty inside space S1 is formed between the inside leather part 2*c* of the pad 2 and the inside surface 3*a* of the key 3, some of the keypad structure A for the tone hole may be used in a state where an empty inside space S1 is formed. However, since most of the keypad structures A for tone holes are formed so that the empty inside space S1 are irregularly formed. Therefore, by the irregularly formed inside space S1, as shown in FIG. 5*b*, while a load is concentrated on the space S2 which is very empty among the inside spaces S1 during use, the space S2 which is very empty among the inside spaces S1 is deformed. Even when the pad 2 that is detached from the upper peripheral edge part 1*b* of the tone hole tube 1 and closes the upper peripheral edge part 1*b* is in close contact, an opened space S is generated, and the sound leaks through the opened space S, and the vibration of the desired sound is disturbed.

Figure 4:
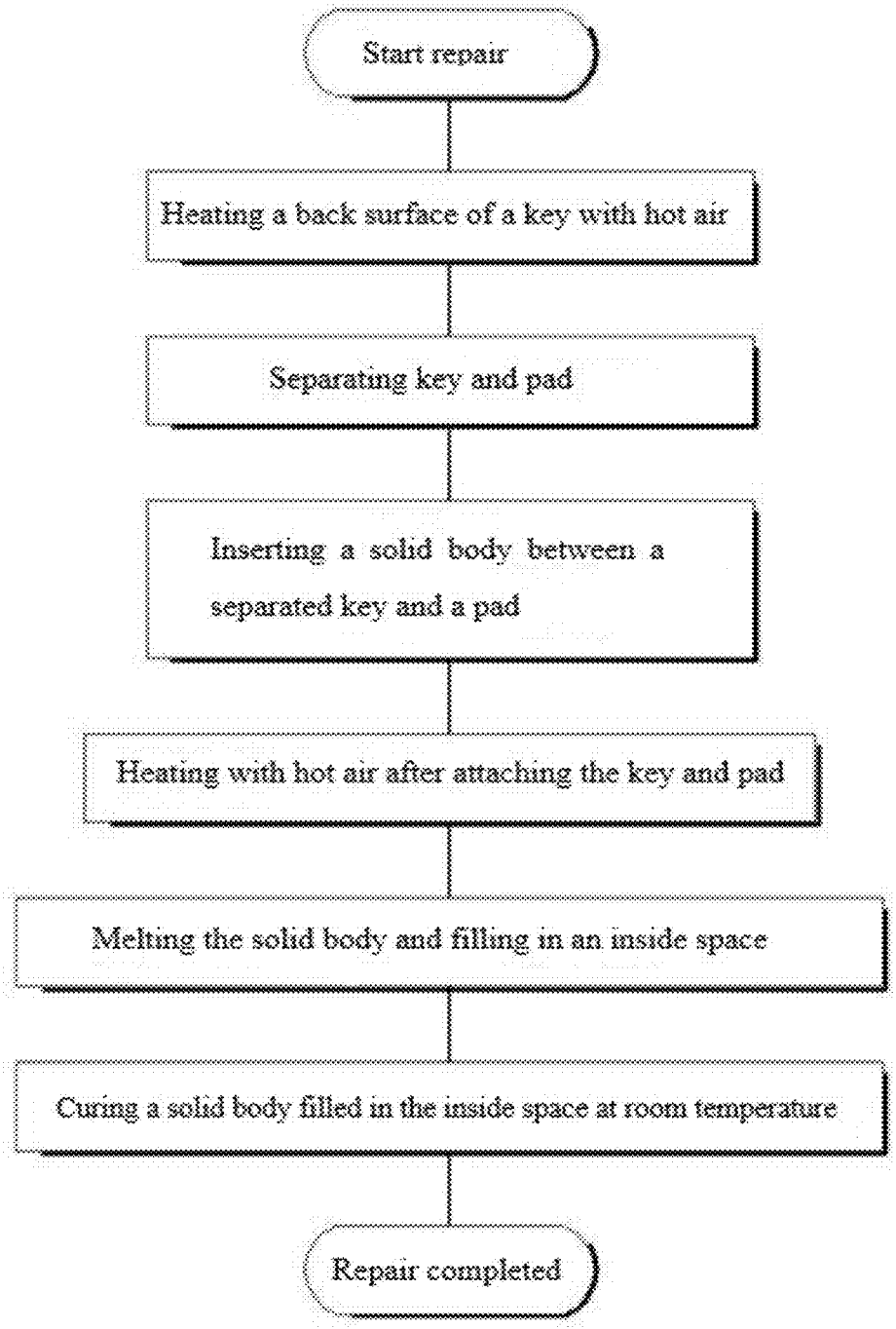
FIG. 4 is a block diagram of a method of molding the keypad structure for woodwind instrument tone holes according to a first embodiment of the present invention.

In this way, even when the pad 2 that is detachably attached to the upper peripheral edge part 1*b* of the tone hole tube 1 and closes the upper peripheral edge part 1*b* is in close contact, in order to repair the generation of an opened space S, as shown in FIG. 4, first, the back surface 3*b* of the key 3 to be repaired is heated with hot air to a temperature of about 60 to 95° C., preferably 80° C. to separate the adhesive part 7*a* of the pad 2 attached to the inside surface 3*a* of the key 3. The same solid body 7 as the component of the joining part 7*a* is inserted between the separated pad 2 and the inside surface 3*a* of the key 3, the pad 2 is inserted into the inside surface 3*a* of the key 3, and reheated with hot air. As the solid body 7 melts, the entire inside space S1 is filled, and filled so that there is no inside space S1. And, when the inside space S1 is filled with the solid body 7 in this way, and then the hot air is removed, the solid body 7 filled in the inside space S1 is cured at room temperature. Therefore, the space disappears in the joining part of the repaired key 3 and the pad 2, and only three parts of the pad 2, the solid body 7, and the key 3 are present.

The solid body 7 can be melted in hot air such as solid silicone and shellac used as an adhesive for the pad 2 of saxophone having a large pad, or an object that maintains a solid state at room temperature may be used, or thin paper or thin vinyl may be used for the pad 2 such as a flute with a small pad.

Figure 5C:
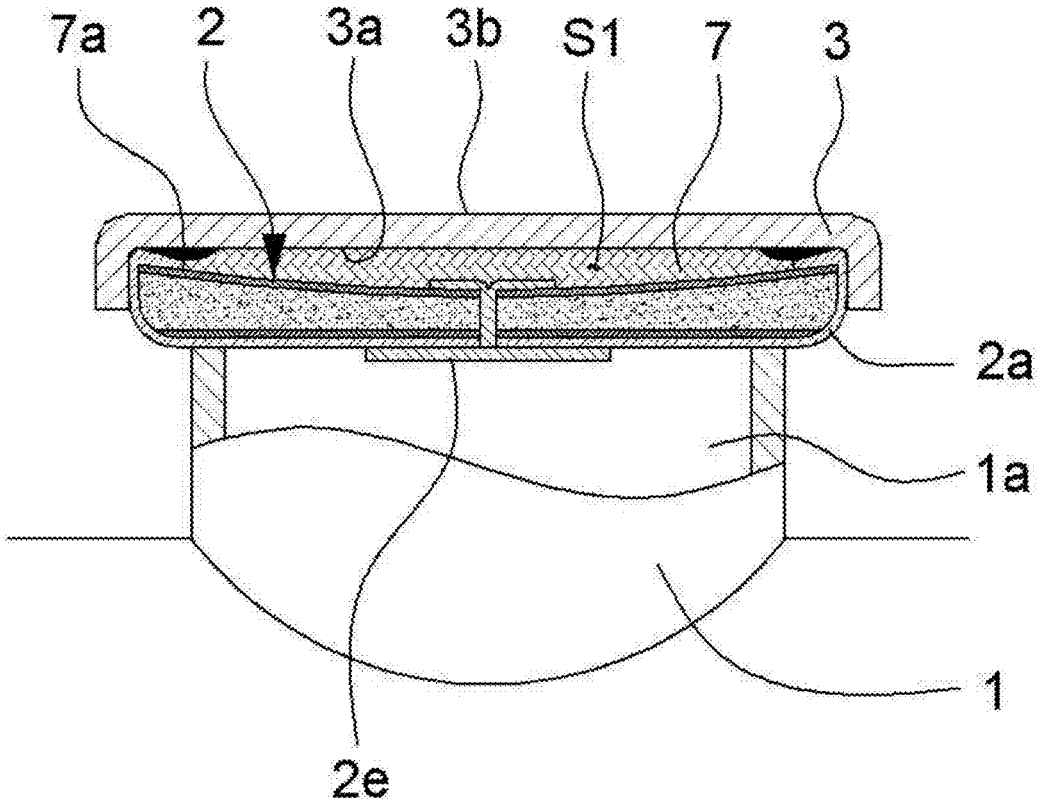
Figure 6:
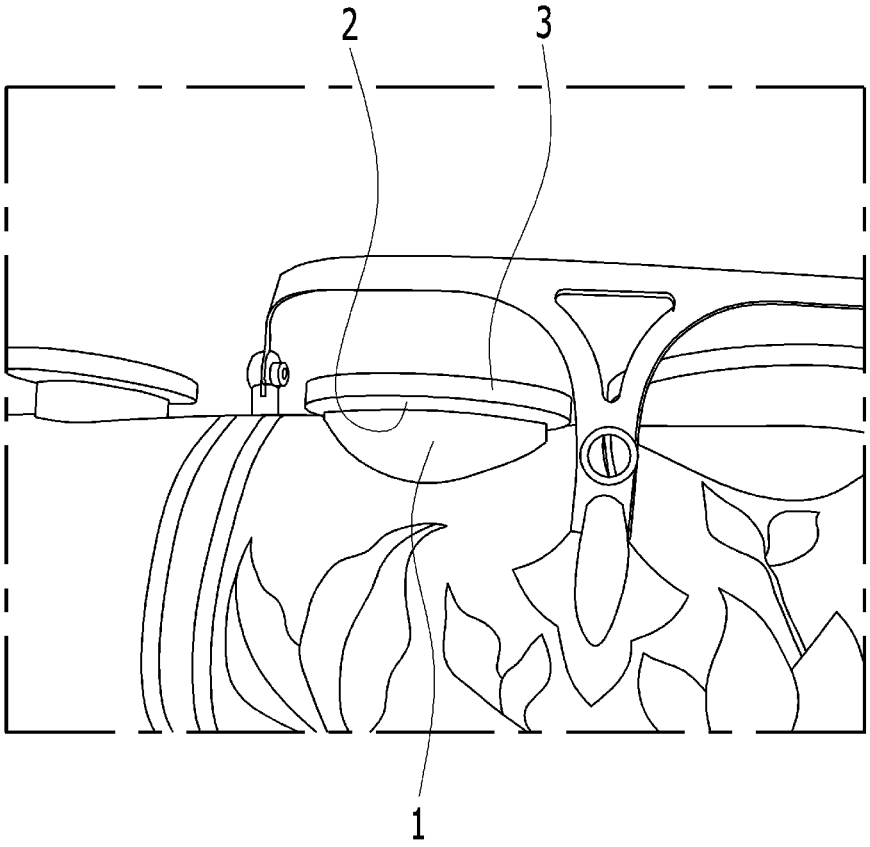
FIG. 6 is a photograph showing a pad that is in close contact with the upper part of the tone hole tube of the keypad structure for a woodwind instrument tone hole according to the first embodiment of the present disclosure.

In this way, the solid body 7 filled in the entire inside space S1 also fills the contracted empty space S2 in the inside space S1, so that all the spaces S1 and S1 disappear. Thus, as shown in FIG. 5C, the space disappears in the joining part of the repaired key 3 and the pad 2, and only three parts of the pad 2, the solid body 7 and the key 3 are present. In such a state, even when a woodwind instrument is used, the solid body 7 is filled between the key 3 and the pad 2 of the keypad structure A. Thus, in spite of long-term use without deformation, the pad 2 that is detached from the upper peripheral edge part 1*b* of the tone hole tube 1 and closes the upper peripheral edge part makes it possible to completely block the upper peripheral edge part 1*b* of the tone hole tube 1 without a gap S.

As described above, in the keypad structure A for woodwind instrument tone holes according to the present disclosure, an empty space inside the pad and the key is removed, thereby improving the adhesion of a keypad connected to a tone hole tube of the woodwind instrument, preventing the sound from being exposed to the outside through the tone hole tube and the pad, generating excellent resonance so that the resonance of the desired sound can occur consistently.

INDUSTRIAL APPLICABILITY

The keypad structure for woodwind instrument tone holes according to the present disclosure can repeatedly produce the same product in the woodwind instrument industry for producing general woodwind instruments, which can thus be an invention with industrial applicability.

EXPLANATION OF SYMBOLS

A . . . keypad structure for woodwind instrument tone holes
B . . . woodwind instrument
1 . . . tone hale tube
1*a* . . . tone hole
1*b* . . . peripheral edge part
2 . . . pad
3 . . . key
4 . . . arm
5 . . . key rod
6 . . . key button

What is claimed is:

1. A keypad structure A for woodwind instrument tone holes comprising: a plurality of tone hole tubes 1 in which tone holes la are formed on the woodwind instrument B, a pad 2 detachably attached to the tone hole tubes 1, and a key 3 to which the pad 2 is attached to the inside surface and which moves the pad 2, wherein the keypad structure A for a woodwind instrument tone holes is characterized in that a separated pad 2 is disposed on the back surface 3*b* of the key 3, a solid body 7 is inserted between the separated pad 2 and the inside surface 3*a* of the key 3, heated with hot air to melt the solid body 7, the solid body 7 filled in the inside space S1 between the pad 2 and the inner surface 3*a* of the key 3 is cured at room temperature, and in the joining part between the key 3 and the pad 2, the inside space S1 disappears and three parts of the pad 2, the solid body 7 and the key 3 are present.

2. The keypad structure for woodwind instrument tone holes according to claim 1, wherein:

the solid body 7 is selected from solid silicone, shellac, thin paper or thin vinyl.

* * * * *